US010245215B2

(12) United States Patent
Triplett

(10) Patent No.: US 10,245,215 B2
(45) Date of Patent: Apr. 2, 2019

(54) PILL CUTTING AND STORAGE DEVICE

(71) Applicant: Tyson Triplett, Provo, UT (US)

(72) Inventor: Tyson Triplett, Provo, UT (US)

(73) Assignee: Tyson Triplett, Provo, UT (US)

( * ) Notice: Subject to any disclaimer, the term of this patent is extended or adjusted under 35 U.S.C. 154(b) by 345 days.

(21) Appl. No.: 14/666,007

(22) Filed: Mar. 23, 2015

(65) Prior Publication Data

US 2015/0265501 A1 Sep. 24, 2015

Related U.S. Application Data

(60) Provisional application No. 61/968,573, filed on Mar. 21, 2014.

(51) Int. Cl.
*A61J 7/00* (2006.01)
*B26B 17/00* (2006.01)

(52) U.S. Cl.
CPC ..... *A61J 7/0007* (2013.01); *B26B 17/006* (2013.01)

(58) Field of Classification Search
CPC ..... A61J 7/007; A61J 7/0007; A45D 29/023; B26B 17/006
USPC ..... 30/186–193, 27, 176
See application file for complete search history.

(56) References Cited

U.S. PATENT DOCUMENTS 632,444 A 9/1899 Chaussinand
2,799,923 A * 7/1957 Senshu ..... A45D 29/023 30/124
2,985,957 A 5/1961 Freedman
3,031,754 A * 5/1962 Pocoski ..... A45D 29/023 30/28
3,169,312 A * 2/1965 Fink ..... A45D 29/023 30/28
3,336,666 A * 8/1967 Calkin ..... H02G 1/1212 30/90.1
3,392,447 A * 7/1968 Hendricks ..... B26F 1/36 30/124
3,517,871 A * 6/1970 Gaffney ..... A61J 7/0007 206/530
3,777,398 A 12/1973 Routh, Jr.
3,943,948 A * 3/1976 Sartore ..... A45D 29/02 132/73

(Continued)

FOREIGN PATENT DOCUMENTS

CN 202699630 1/2013
DE 4238843 11/1992

(Continued)

*Primary Examiner* — Kenneth E Peterson
(74) *Attorney, Agent, or Firm* — Kunzler, PC; Bruce R. Needham

(57) ABSTRACT

An apparatus for cutting includes a base, a fixed member attached to the base, where the fixed member includes a first cutting wedge, and a lever arm pivotably attached to the base and/or the fixed member at a pivot point. The lever arm includes a second cutting wedge, where the lever arm is positionable between an open position and a closed position. The first cutting wedge and the second cutting wedge are oriented perpendicular to the pivot point and the lever arm rotates to move the second cutting wedge to contact the first cutting wedge. A cutting surface of the first cutting wedge aligns with a cutting surface of the second cutting wedge when the lever arm is in the closed position.

17 Claims, 6 Drawing Sheets

(56) References Cited

U.S. PATENT DOCUMENTS 4,009,651 A * 3/1977 Adams ..... A47J 43/26 30/120.3
4,173,826 A * 11/1979 Leopoldi ..... A61J 7/0007 225/103
4,179,806 A * 12/1979 Lieptz ..... A61J 7/0007 206/528
4,640,011 A * 2/1987 Gamble ..... A45D 29/023 132/73.5
4,824,000 A 4/1989 Baxter et al.
5,038,475 A * 8/1991 Wolff ..... A61J 7/0007 225/103
5,178,337 A 1/1993 Lupoli
5,459,926 A * 10/1995 Perea ..... A45D 29/023 132/75.5
6,342,248 B1 * 1/2002 Miyabe ..... A61J 1/035 206/532
6,637,685 B1 10/2003 Kruger
6,813,832 B2 * 11/2004 Alexander ..... B26B 13/22 30/124
6,966,509 B2 11/2005 Janzen
7,243,826 B2 * 7/2007 Darst ..... A61J 7/0007 225/103
7,445,172 B1 11/2008 Bucknor
7,458,300 B2 * 12/2008 Williams ..... A61J 7/0007 225/1
7,699,251 B2 4/2010 Frick
8,925,434 B2 * 1/2015 Omura ..... A61J 7/0007 225/93
2003/0010349 A1 * 1/2003 Rende ..... A45D 29/023 132/75
2003/0019900 A1 1/2003 Dienst
2009/0064509 A1 * 3/2009 Farnworth ..... B26F 1/36 30/363
2011/0289784 A1 * 12/2011 Jones ..... B26B 17/006 30/175
2013/0125722 A1 5/2013 Omura et al.

FOREIGN PATENT DOCUMENTS

DE 20000294 1/2000
DE 202005018139 3/2006
JP 2000084049 9/1998

* cited by examiner

Side View

Section "A-A"
(2x scale)

Side View
(Cover closed)

Section "B-B"
(2x scale)

PILL CUTTING AND STORAGE DEVICE

CROSS-REFERENCES TO RELATED APPLICATIONS

This application claims the benefit of U.S. Provisional Patent Application No. 61/968,573 entitled "PILL CUTTING AND STORAGE DEVICE" and filed on Mar. 21, 2014 for Tyson Triplett, which is incorporated herein by reference.

FIELD

This invention relates to cutting and more particularly relates to a device that cut objects, which may include pills.

BACKGROUND

Often people find reasons to cut pills. For example, a person may desire to take a half of a dose of a medication, or to increase a dose by half. In other cases, pills of a certain dosage may be less expensive than a lower dosage so splitting a pill may be desirable. Typical pill cutters are difficult to use and often don't work well. Most use a razor, which can dull easily and has a tendency to bend. In addition, most pill cutters move the blades in a scissor-like motion contacting a pill to be cut on one edge, which can push the pill and often causes the pill to break unevenly or to break into multiple pieces.

SUMMARY

An apparatus for cutting includes a base, a fixed member attached to the base, where the fixed member includes a first cutting wedge, and a lever arm pivotably attached to the base and/or the fixed member at a pivot point. The lever arm includes a second cutting wedge, where the lever arm is positionable between an open position and a closed position. The first cutting wedge and the second cutting wedge are oriented perpendicular to the pivot point and the lever arm rotates to move the second cutting wedge to contact the first cutting wedge. A cutting surface of the first cutting wedge aligns with a cutting surface of the second cutting wedge when the lever arm is in the closed position.

In one embodiment, the first cutting wedge and the second cutting wedge each taper to the cutting edge by way of a wedge shape. In another embodiment, the wedge shape has an angle of between 50 degrees and 80 degrees, where the angle is measured with respect to the cutting edge and between a surface of the wedge shape on either side of the cutting edge. In another embodiment, the angle is approximately 60 degrees.

In one embodiment, the apparatus includes a cover positionable over compartments formed by the base, the fixed member and the lever arm in a closed position. In another embodiment, the cover is attached to the apparatus at a pivot point, where the cover rotates between a closed position and an open position. The cover in the closed position covers the compartments and in the open position exposes the compartments for access. In another embodiment, the cover magnetically attaches to the fixed member and/or the lever arm at one or more locations. In another embodiment, the cover is substantially planar and is transparent over a portion of the apparatus where the first and second cutting wedges meet.

In another embodiment, the base, the fixed member and the lever arm form a first compartment and a second compartment and the first and second compartments are the compartments. The base forms a bottom, the fixed member forms sides of the first and second compartments, and the lever arm forms sides of the first and second compartments when the lever arm is in the closed position. The first and second cutting wedges divide the first compartment from the second compartment, and the cover forms a top of the first and second compartments. In another embodiment, the first and second compartments are substantially cylindrical. In another embodiment, the cover connects to the apparatus at the pivot point of the lever arm. In a further embodiment, the apparatus includes a pivot member. In the embodiment, the pivot member may extend through the cover and the lever arm and connect to the base and/or the fixed member. In the embodiment, a portion of the pivot member may extend through the fixed member and/or the base and may connect to the lever arm and a portion of the pivot member may extend through the cover and may connect to the lever arm.

In one embodiment, the first cutting wedge and the second cutting wedge each have a width that spans a space between the base and a top edge of the fixed member and the lever arm. The top edge of the fixed member and the top edge of the lever arm are distal to the base. In another embodiment, the apparatus includes a recess in the base adjacent to the first cutting wedge. The recess is shaped to accommodate an edge of an object to be cut and to support the object in a position to split the object when the lever arm moves between the open position and closed position. In another embodiment, the first cutting wedge and the fixed member are of unitary construction and the second cutting wedge and the lever arm are of unitary construction.

Another apparatus for cutting includes a fixed base, where the fixed base includes a base and a fixed member with a first cutting edge. The apparatus includes a lever arm attached to the fixed at a pivot point and the lever arm includes a second cutting wedge. The apparatus includes a pivot member coupling the lever arm to the fixed base at the pivot point. The lever arm is positionable between an open position and a closed position. The first cutting wedge and the second cutting wedge are oriented perpendicular to the pivot point and where the lever arm rotates with respect to the pivot point to move the second cutting wedge to contact the first cutting wedge where a cutting surface of the first cutting wedge aligns with a cutting surface of the second cutting wedge when the lever arm is in the closed position. The base, the fixed member and the lever arm form a first compartment on a first side of the first and second cutting wedges and a second compartment on a second side of the first and second cutting wedges. The first side is opposite the second side and the base forms a bottom to the first and second compartments.

In one embodiment, the apparatus includes a cover rotatably coupled to the apparatus at the pivot point. The cover rotates between a first position that covers the first and second compartments when the lever arm is in the closed position, and an open position that exposes at least a portion of the first and second compartments. In another embodiment, the cover includes a material that is see-through for at least the first compartment and second compartment. In another embodiment, the fixed member is shaped to accommodate the lever arm at the pivot point to maintain a joint substantially without a gap while the lever arm rotates between the open position and closed position.

Another apparatus for cutting includes a base, a fixed member attached to the base, where the fixed member includes a first cutting wedge, and a lever arm pivotably attached to the base and/or the fixed member at a pivot point.

The lever arm includes a second cutting wedge and the lever arm is positionable between an open position and a closed position. The first cutting wedge and the second cutting wedge each taper to the cutting edge by way of a wedge shape, where each wedge shape has an angle between 50 degrees and 80 degrees with respect to the cutting edge. The apparatus includes a cover rotatably coupled to the base at the pivot point. The cover is shaped to cover two compartments formed between the base, the fixed member, the first and second cutting wedges, and the lever arm when the lever arm is in the closed position, where rotation of the cover exposes the compartments. The cover includes a transparent material so the two compartments are visible through the cover. The apparatus includes a pivot member located at the pivot point and extending through the cover and lever arm and attached to the fixed member or the base. The first cutting wedge and the second cutting wedge are oriented perpendicular to the pivot point and the lever arm rotates to move the second cutting wedge to contact the first cutting wedge where a cutting surface of the first cutting wedge aligns with a cutting surface of the second cutting wedge when the lever arm is in the closed position.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
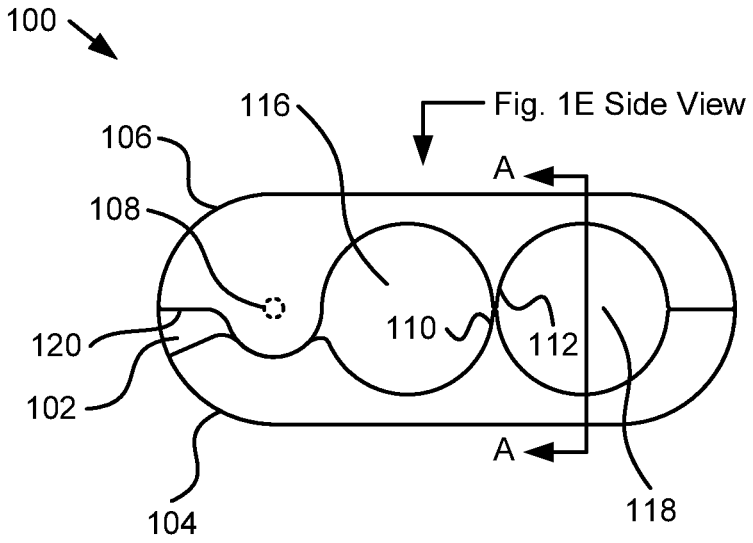
FIG. 1A is a top view illustrating one embodiment of an apparatus in a closed position in accordance with one embodiment of the present invention.
Figure 1B:
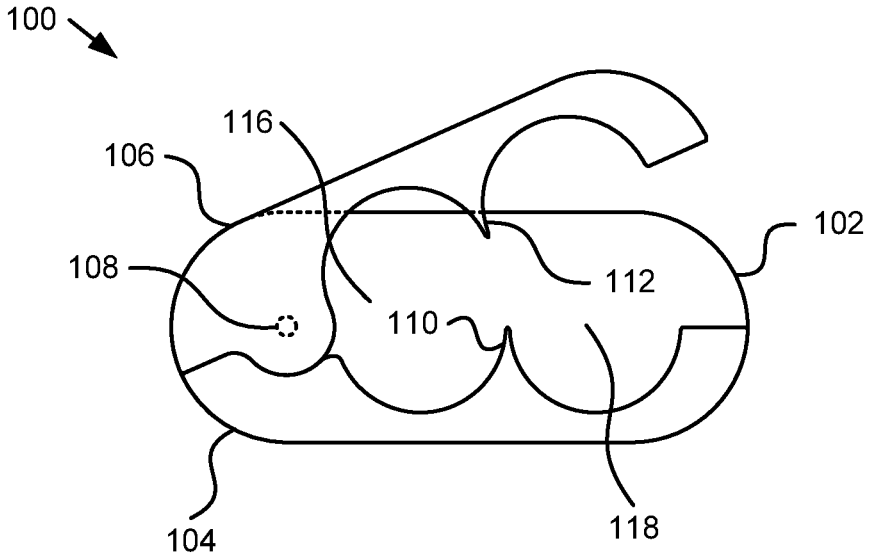
FIG. 1B is a top view illustrating the embodiment of the apparatus in an open position in accordance with one embodiment of the present invention.
Figure 1C:
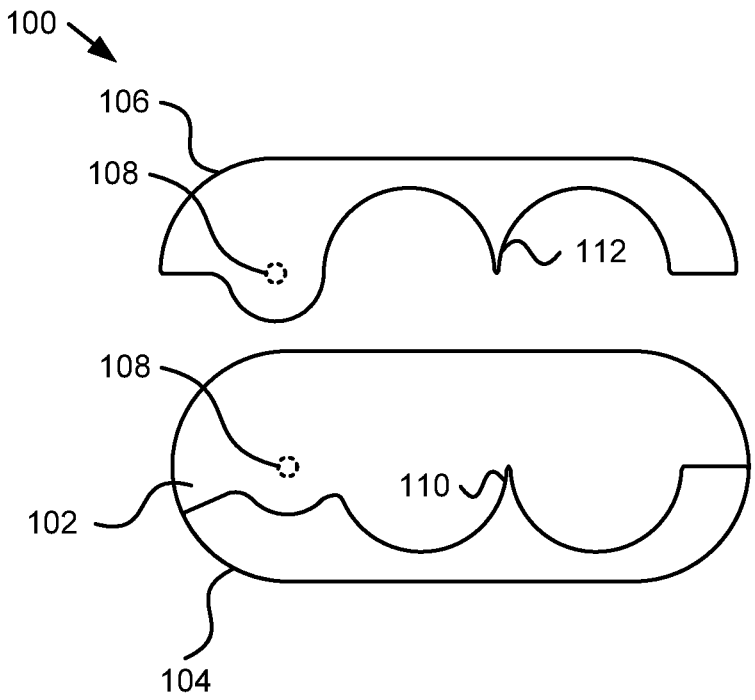
FIG. 1C is a top view illustrating parts of the embodiment of the apparatus in accordance with one embodiment of the present invention.
Figure 1D:
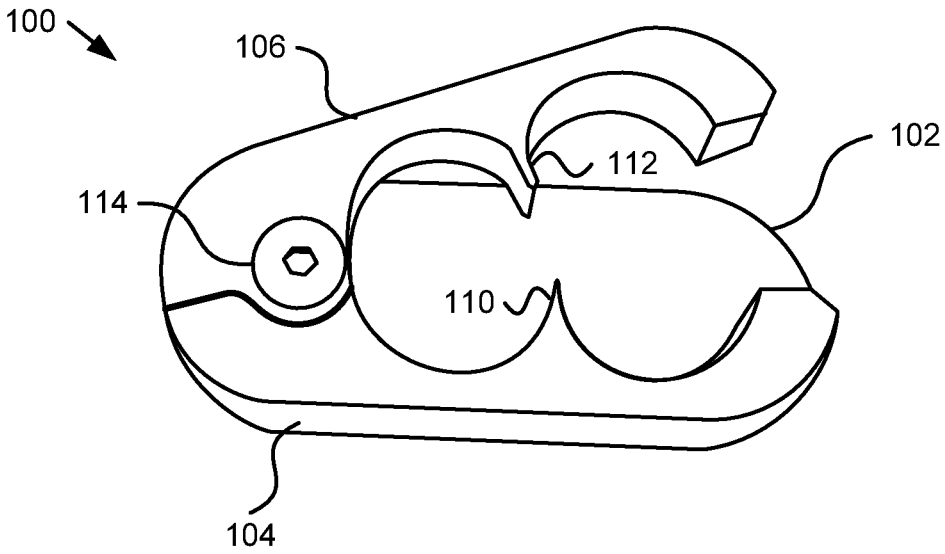
FIG. 1D is a perspective view illustrating the embodiment of the apparatus in an open position in accordance with one embodiment of the present invention.
Figure 1E:
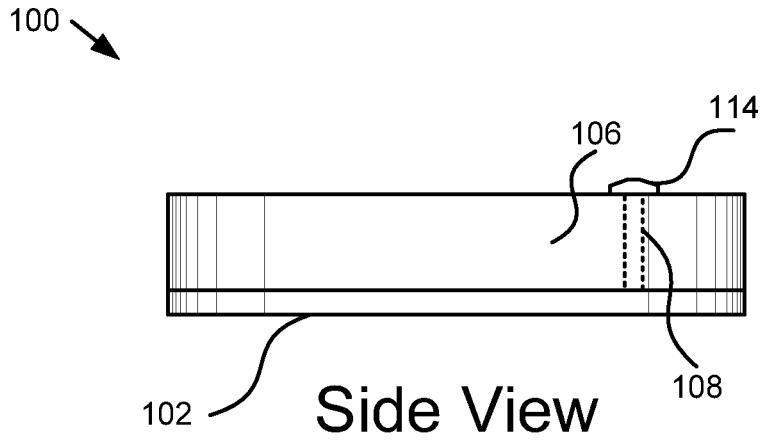
FIG. 1E is a side view illustrating the embodiment of the apparatus in a closed position in accordance with one embodiment of the present invention.
Figure 1F:
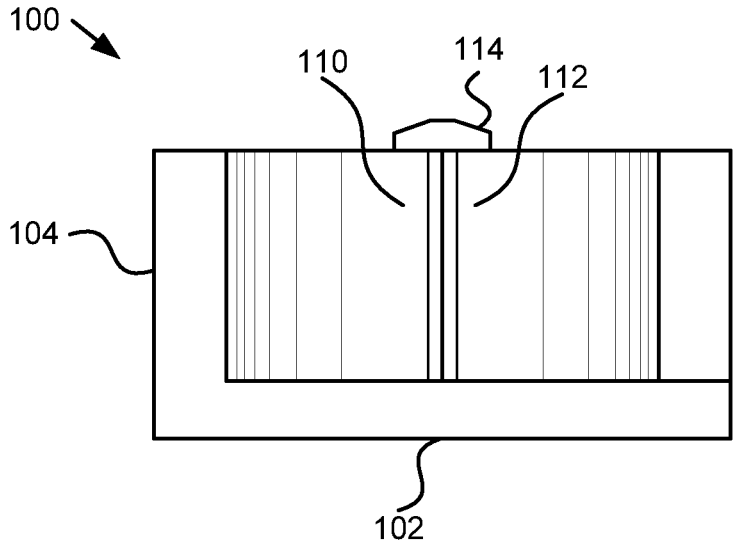
FIG. 1F is a section "A-A" view illustrating the embodiment of the apparatus in a closed position in accordance with one embodiment of the present invention.

FIG. 1A is a top view illustrating one embodiment of an apparatus 100 in a closed position in accordance with one embodiment of the present invention. FIG. 1B is a top view illustrating the embodiment of the apparatus 100 in an open position. FIG. 1C is a top view illustrating parts of the embodiment of the apparatus 100. FIG. 1D is a perspective view illustrating the embodiment of the apparatus 100 in an open position. FIG. 1E is a side view illustrating the embodiment of the apparatus 100 in a closed position. FIG. 1F is a section "A-A" view illustrating the embodiment of the apparatus 100 in a closed position. The apparatus 100 includes a base 102, a fixed member 104, a lever arm 106, a pivot point 108, a first cutting wedge 110, a second cutting wedge 112, a pivot member 114, a first compartment 116, and a second compartment 118 which are described below.

In one embodiment, the apparatus 100 is designed to cut items, such as pills. For example, the apparatus 100 may cut a pill in half. In another embodiment, the apparatus 100 may be used to cut other items, such as candy, nuts, or other items. The apparatus 100 includes a base 102 that forms a bottom of the apparatus 100 and the first and second compartments 116, 118. The fixed member 104 extends away from the base 102 to form sides of the first and second compartments 116, 118 and the first cutting wedge 110. The lever arm 106, in one embodiment, is pivotably attached to the base 102 at the pivot point 108. The lever arm 106 also forms sides of the first and second compartments 116, 118 and is positionable between an open position and a closed position. The lever arm 106 rotates away from the fixed member 104 so that the second cutting wedge 112 is moved away from the first cutting wedge 110. As the lever arm 106 moves between the closed position and an open position, the lever arm 106 passes over a portion of the base 102. In the closed position, in one embodiment, the lever arm 106 is in close proximity to the base 102 so there is no space or very little space between the lever arm 106 and the base 102. For example, a surface of the lever arm 106 facing the base 102 and the base 102 in an area where the lever arm moves 106 may be planar or substantially planar so that the lever arm 106 and the base 102 remain in close proximity between the open and closed positions. Substantially planar, as used herein, may include surfaces that are flat but may not be fully parallel, may include surfaces that are planar along edges of the first and second compartments 116, 118, or other minor variation from completely planar.

In one embodiment, the lever arm 106 includes a ledge 120 that prevents the lever arm 106 from moving past a certain angle, as shown in FIG. 1B. Stopping movement of the lever arm 106 may be advantageous to keep the lever arm 106 in a more convenient angle in the open position for handling during pill cutting. In another embodiment, the lever arm 106 is shaped without the ledge 120 to allow movement to greater distances away from the closed position.

In the closed position, the base 102, the fixed member 104, and the lever arm 106 form the first compartment 116 and the second compartment 118. The base 102 forms a bottom of the first and second compartments 118. The fixed member 104, in one embodiment, forms part of the sides of the first and second compartments 116, 118 and the lever arm 106 forms the remaining part of the first and second compartments 116, 118. While the first and second compartments 116, 118 are shown as cylindrical, one of skill in the art will recognize that other shapes are possible, such as a rectangular outline, a square outline, an octagonal outline, etc. Cylindrical first and second compartments 116, 118 or other designs without deep corners may be advantageous for ease in retrieving pills without the pill or portion of a pill being trapped in a corner. In one embodiment, the base 102 includes divots or depressions in the areas of the first and second compartments 116, 118. In another embodiment, the base 102 is flat in the areas of the first and second compartments 116, 118.

The lever arm 106 includes a second cutting wedge 112. The first cutting wedge 110 and the second cutting wedge 112 are oriented perpendicular to the pivot point 108 and the lever arm 106 rotates to move the second cutting wedge 112 to contact the first cutting wedge 110 where a cutting surface of the first cutting wedge 110 aligns with a cutting surface of the second cutting wedge 112 when the lever arm 106 is in the closed position. Typical pill cutters have blades aligned in a direction in line with a pivot point and cut in a scissor-like movement. These pill cutters contact the pill at one edge and have a tendency to cause the pill to crumble, break unevenly, etc. By positioning the first and second cutting wedges 110, 112 to be perpendicular to the pivot point 108, the first and second cutting wedges 110, 112 contact a pill at an angle that is vertical or nearly vertical. The farther the pivot point 108 is from the first and second cutting wedges 110, 112, the more vertically the movement of the action to cut pills.

Advantageously, positioning the first and second cutting wedges 110, 112 perpendicular to the pivot point 108 allows first and second cutting wedges 110, 112 to move parallel to each other and mostly along the same plane vertically instead of a scissor-like cut, like other pill cutters. Moving the first and second cutting wedges 110, 112 together while the cutting surfaces are parallel causes more blade engagement than typical pill cutters and causes a cleaner cut of a pill and typically has less pill breakage and a more precise cut than typical pill cutters. Initially the cutting surfaces of the first and second cutting wedges 110, 112 score the surface of a pill being cut, effectively weakening the pill. As cutting pressure is increased, cutting pressure from the second cutting wedge 112 is focused on the score mark of one side of the pill and through the pill to the oppositely positioned first cutting wedge 110 and score mark caused by the first cutting wedge 110. This initial scoring and focused force between the first and second cutting wedges 110, 112 typically results in less crumbling than for pill cutters of the prior art.

While the first and second cutting wedges 110, 112 are positioned centrally with regard to the formed first and second compartments 116, 118, other locations of the first and second cutting wedges 110, 112 are possible. Where the second cutting wedge 112 is positioned differently than shown in FIGS. 1A-1F, one of skill in the art will recognize that the first cutting wedge 110 is positioned so the cutting surfaces of the first and second cutting wedges 110, 112 come together in the closed position. Where the lever arm 106 includes a portion beyond the second cutting wedge 112 so that the second cutting wedge 112 is between the pivot point 108 and a portion distal to the pivot point 108, a lever action may increase force on the pill compared to force exerted at the end of the lever arm 106 distal to the pivot point 108. Where the second cutting wedge 112 is positioned further away from the pivot point 108, a smaller second compartment 118 may result and the angle that the first and second cutting wedges 110, 112 come together may be closer to vertical than the embodiment of the apparatus 100 shown in FIGS. 1A-1F.

In one embodiment, the base 102 and the fixed member 104 are of unitary construction, meaning they are formed together or are of one piece of material. The base 102 and the fixed member 104 may be called a fixed base, which is a combination of the base 102 and the fixed member 104. For example, the base 102 and the fixed member 104 may be milled from a single piece of metal, such as aluminum, or may be cast as one part. In another embodiment, the base 102 and the fixed member 104 are formed separately and then connected, for example, by an adhesive, by fasteners, etc. In another embodiment, at least a portion of the first and second cutting wedges 110, 112 may be of a material different from. For example, the first and second cutting wedges 110, 112 may be made of a metal or other hard material while the base 102, the fixed member 104, and lever arm 106 may be made of a different, softer material, such as a plastic, a composite, etc.

In one embodiment, the lever arm 106 includes material that surrounds the pivot point 108 in a first shape and a portion of the fixed member 104 adjacent to the first shape has a second shape so that the first shape of the lever arm 106 and the second shape of the fixed member 104 remain in close proximity as the lever arm 106 is moved between the open and closed positions. For example, the first shape may be circular with a fixed radius from the pivot point 108 and the second shape may be a circular recess with a fixed radius from the pivot point 108 just longer than the radius of the first shape so that the first shape of the lever arm 106 and the second shape of the fixed member 104 remain in close proximity as the lever arm 106 is moved between the open and closed positions. Among other advantages, keeping the first shape of the lever arm 106 and the second shape of the fixed member 104 in close proximity as the lever arm 106 is moved between the open and closed positions helps prevent portions of a pill from escaping the first compartment 116.

Other methods may also be used to close a gap between the lever arm 106 and the fixed member 104. For example, the lever arm 106 or the fixed member 104 may include a flexible seal that rides along a portion of the lever arm 106 as the lever arm moves. In another example, a flexible material may be connected between the lever arm 106 and the fixed member 104 that stretches or conforms while the lever arm 106 travels between the open and closed positions. One of skill in the art will recognize other ways to prevent portions of a pill from moving through a gap between the lever arm 106 and the fixed member 104.

The pivot point 108, in one embodiment, includes a hole in the lever arm 106 and a pivot member 114 may extend through the hole. The pivot member 114, in various embodiments, may be a screw, a bolt, a pin, a rivet, or any other device that secures the lever arm 106 to the base 102 and/or fixed member 104. The pivot member 114, in one embodiment, may include multiple parts. For example, the pivot member 114 may include a screw or bolt within a sleeve. In one embodiment, the pivot point 108 includes a hinge where the pivot member 114 includes a hinge pin. In another embodiment, the pivot point 108 includes a hole through the base 102 and/or fixed member 104 and the pivot member 114 extends through the hole. One of skill in the art will recognize other pivot point designs that will allow the lever arm 106 to rotate about the pivot point 108.

In one embodiment, the apparatus 100 may include a spring force mechanism (not shown) that exerts a force in a direction to move the lever arm 106 to the closed position. In another embodiment, the spring force mechanism exerts a force to move the lever arm 106 away from the closed position. In another embodiment, the apparatus 100 includes a latch (not shown) that holds the lever arm 106 in a closed position. For example, the spring force mechanism may provide a force to keep the apparatus 100 in an open position and the latch may be used to counter the spring force mechanism to keep the apparatus 100 in a closed position. In other embodiments, the pivot point 108 may be designed with a friction mechanism (not shown) that may be used to maintain the apparatus 100 in a closed position. For example, the pivot member 114 may include a washer and a threaded bolt or screw that may be tightened to increase a friction force. Maintaining the lever arm 106 of the apparatus 100 in a closed position may be desirable in some embodiments where the first and/or second compartments 116, 118 are used to hold pills or other items.

The base 102, fixed member 104 and lever arm 106 are shown with rounded edges. Other shapes may also be used. For example, the apparatus 100 may be substantially rectangular, may include divots, such as for fingers, may include design elements, such as grooves, patterns, etc. One of skill in the art will recognize other cutter designs that include a base 102, a fixed member 104 with a first cutting wedge 110, and a lever arm 106 with a second cutting wedge 112 where the lever arm 106 rotates about a pivot point 108 where cutting surfaces of the first and second cutting wedges 110, 112 are positioned perpendicular to the pivot point 108.

In one embodiment, the first cutting wedge 110 and the second cutting wedge 112 each have a width that spans a space between the base 102 and a top edge of the fixed member 104 and the lever arm 106. The top edge of the fixed member 104 and the top edge of the lever arm 106 are distal to the base 102. For example, the first and second cutting wedges 110, 112 may be as wide as the fixed member 104 and/or lever arm 106 to form a complete separation between the first and second compartments 116, 118 and may allow cutting of larger objects than if the first and second cutting wedges 110, 112 were not as wide.

Figure 2A:
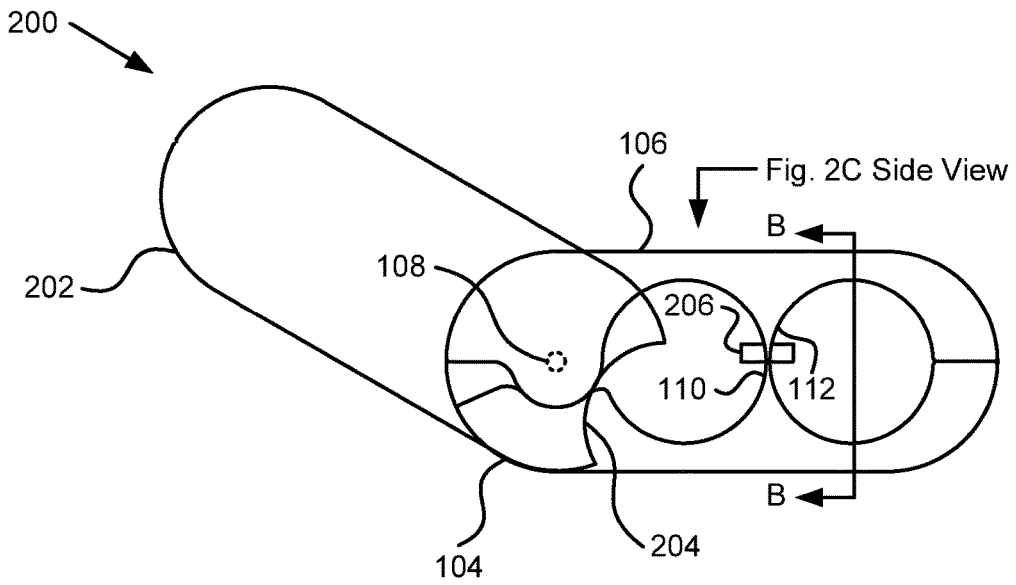
FIG. 2A is a top view illustrating a second embodiment of an apparatus in a closed position with a cover in an open position in accordance with one embodiment of the present invention.
Figure 2B:
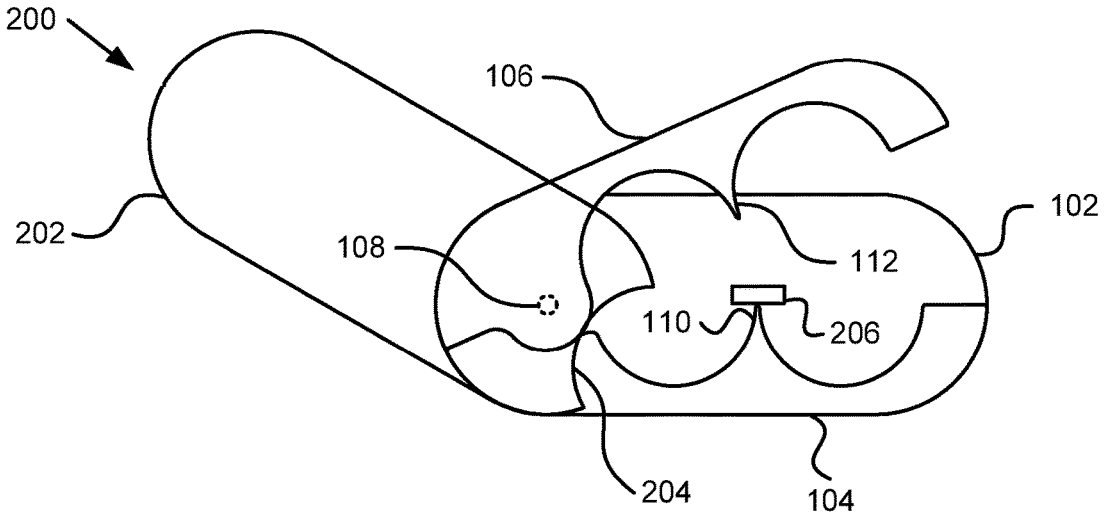
FIG. 2B is a top view illustrating the second embodiment of the apparatus in an open position with a cover in an open position in accordance with one embodiment of the present invention.
Figure 2C:
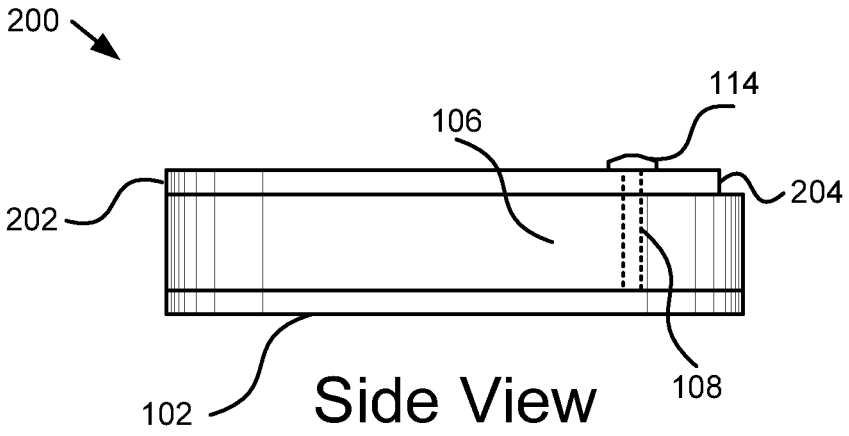
FIG. 2C is a side view illustrating the second embodiment of the apparatus in a closed position with a cover in a closed position in accordance with one embodiment of the present invention.
Figure 2D:
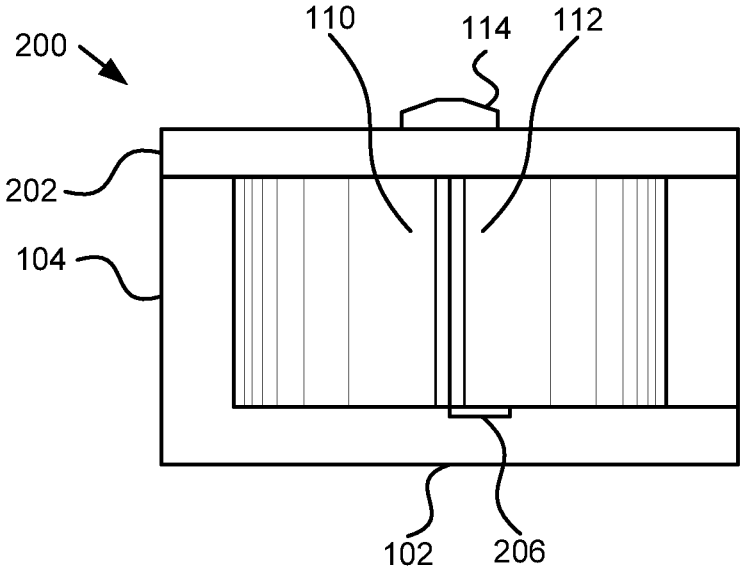
FIG. 2D is a section "B-B" view illustrating the second embodiment of the apparatus in a closed position with a cover in a closed position in accordance with one embodiment of the present invention.

FIG. 2A is a top view illustrating a second embodiment of an apparatus 200 in a closed position with a cover in an open position in accordance with one embodiment of the present invention. FIG. 2B is a top view illustrating the second embodiment of the apparatus 200 in an open position with a cover in an open position. FIG. 2C is a side view illustrating the second embodiment of the apparatus in a closed position with a cover in a closed position. FIG. 2D is a section "B-B" view illustrating the second embodiment of the apparatus in a closed position with a cover in a closed position. The apparatus 200 includes a base 102, a fixed member 104, a lever arm 106, a pivot point 108, a first cutting wedge 110, a second cutting wedge 112, a pivot member 114, a first compartment 116, a second compartment 118, and a ledge 120, which, in one embodiment, are substantially similar to those described above in relation to the apparatus 100 of FIGS. 1A-1F. The apparatus 200, in various embodiments, also may include a cover 202, which may include a cutout 204, and a recess 206, which are described below.

The apparatus 200 includes a cover 202 positionable over compartments formed by the base 102, the fixed member 104 and the lever arm 106 in a closed position. The compartments, in one embodiment, are the first and second compartments 116, 118 depicted in FIGS. 2A and 2B. In other embodiments, other compartments may be included. For example, the base 102, the fixed member 104 and the lever arm 106 may be extended to form another compartment beyond the second compartment 118.

In one embodiment, the cover 202 is attached to the apparatus 200 at a pivot point. In one embodiment, the pivot point is the pivot point 108 shown in FIGS. 2A and 2B. In another embodiment, the pivot point for the cover 202 is in a different location (not shown). For example, the pivot point for the cover 202 may be at an end of the fixed member 104 or an end of the lever arm 106 distal to the pivot point 108 of the lever arm 106. In another embodiment, the pivot point for the cover 202 may include a hinge, or other mechanism and may allow the cover 202 to move up and away from the fixed member 104 and lever arm 106. For example, the hinge may be along a side of the fixed member 104 away from the compartments (i.e. 116, 118).

In other embodiments, the cover 202 pivots away from the fixed member 104 and lever arm 106 using another mechanism, such as a wire guide. In one embodiment, the apparatus 200 includes a latch mechanism (not shown) that holds the cover 202 in a closed position. In another embodiment, the cover 202 is held in position by friction at the pivot point of the cover 202. One of skill in the art will recognize other ways that the cover 202 may pivot away from the fixed member 104 and lever arm 106 and to secure the cover 202 in a closed position.

In one embodiment, the cover 202 rotates between a closed position and an open position, where the cover 202 in the closed position is covers the compartments (i.e. 116, 118) and in the open position exposes the compartments for access. In another embodiment, the cover 202 includes a cutout 204 positioned to expose the first compartment 116 when rotated to a particular position. For the example depicted in FIGS. 2A and 2B, the cutout 204 may expose the first compartment 116 when the cover 202 is 180 degrees from the closed position. In other embodiments, the cutout 204 may be positioned in a different location.

In one embodiment, the cover 202 is substantially planar. In another example, the cover 202 is planar on a side facing the fixed member 104 and lever arm 106. A top of the fixed member 104 and lever arm 106 may also be planar so that the cover 202 may be positioned in close proximity to the lever arm 106 and fixed member 104 at least in the closed position. In another embodiment, a side of the cover 202 facing away from the compartments (i.e. a top side) may be shaped to have at least a portion non-planar. For example, the top side may include groves, bumps, etc. for gripping, may include a design, lettering, may be rounded, etc.

In one embodiment, the cover 202 is transparent over a portion of the apparatus where the first and second cutting wedges 110, 112 meet. For example, the cover 202 may be transparent to allow a user to view cutting of a pill or other object. In another embodiment, the cover 202 is transparent over the first and second compartments 116, 118 so a user can view contents of the first and second compartments 116, 118. In yet another embodiment, the cover 202 is completely transparent. For example, the cover 202 may be made of glass or a transparent plastic. As used herein, transparent means that the cover 202 allows a user to at least partially see through to the compartments and may include a material that is clear, may include a material that is colored while allowing viewing through the colored material, or any other level of transparency. In one embodiment, the cover 202 may be transparent and may also include a design, lettering, etc. while allowing at least partial viewing of the compartments.

In one embodiment, the apparatus 200 includes a recess 206 in the base 102 adjacent to the first cutting wedge 110. The recess 206 is shaped to accommodate an edge of an object to be cut to support the object in a position to split the object when the lever arm 106 moves between the open position and closed position. For example, where the object is a pill, the recess 206 may be shaped to accommodate an edge of a pill to be split so that the pill is in a position where the first and second cutting wedges 110, 112 contact the pill at a desired location. In one embodiment, the recess 206 is rounded to accommodate round pills. In another embodiment, the recess 206 is a rectangular divot to accommodate a wide range of pills or other objects. In another embodiment the recess 206 is at least partially v-shaped along an edge adjacent to the first cutting wedge 110 and an edge distal to the edge adjacent to the first cutting wedge 110. One of skill in the art will recognize other ways to shape the recess 206 to support an object being cut.

Figure 3:
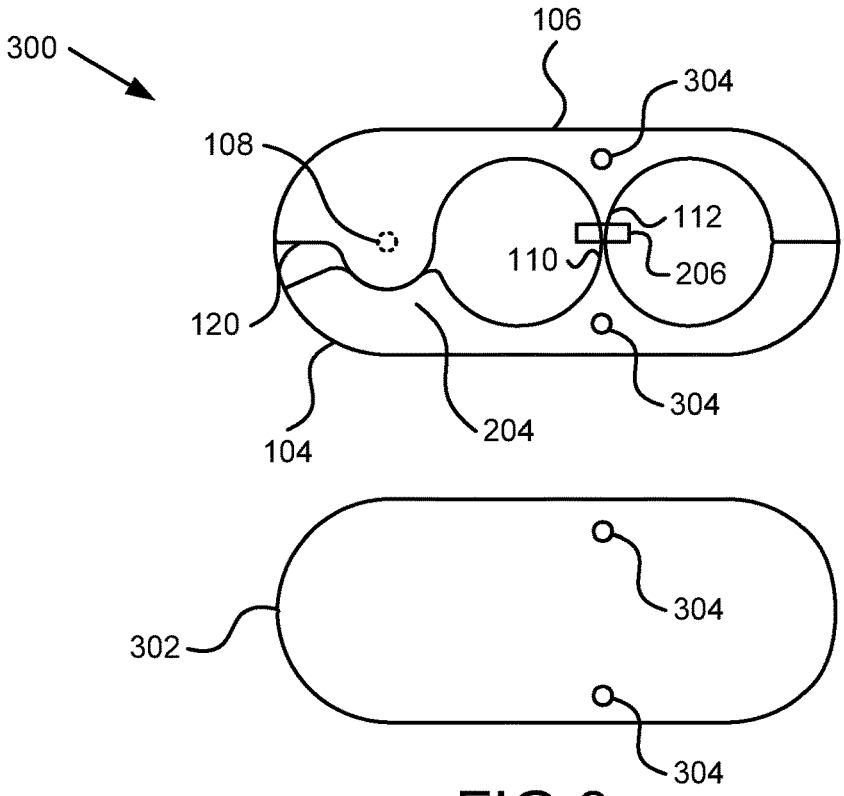
FIG. 3 is a top view illustrating a third embodiment of an apparatus in a closed position with a detached magnetically coupled cover in accordance with one embodiment of the present invention.

FIG. 3 is a top view illustrating a third embodiment of an apparatus 300 in a closed position with a detached magnetically coupled cover in accordance with one embodiment of the present invention. The apparatus 300 includes a base 102, a fixed member 104, a lever arm 106, a pivot point 108, a first cutting wedge 110, a second cutting wedge 112, a pivot member 114, a first compartment 116, a second compartment 118, and a ledge 120, which, in one embodiment, are substantially similar to those described above in relation to the apparatus 100 of FIGS. 1A-1F. The apparatus 300, in one embodiment, includes a cover 302 with magnetic attachments 304, which are described below.

The apparatus 300, in one embodiment, includes a cover 302 which is substantially similar to the cover 202 of the apparatus 200 of FIGS. 2A-2D, but the cover 302 magnetically attaches to the fixed member 104 and/or the lever arm 106 at one or more locations. In one embodiment, the apparatus 300 includes at least one magnetic attachment 304 that enables securing of the cover 302 to the fixed member 104 and/or lever arm 106. In another embodiment, the apparatus 300 includes two or more magnetic attachments 304, as shown in FIG. 3. In one embodiment, the magnetic attachments include two magnets at each attachment point where one magnet is in the cover 302 and one magnet is in the fixed member 104 or the lever arm 106. In another embodiment, the magnetic attachments at an attachment location include a magnet on one side and magnetic attracting material on the other side. The magnets may be permanent magnets, rare earth magnets, etc. and the magnetic attracting material may be iron, steel or other material that is attracted to a magnet. In one embodiment, the cover 302 may pivot at an attachment point, or the cover 302 may be completely removed.

Figure 4:
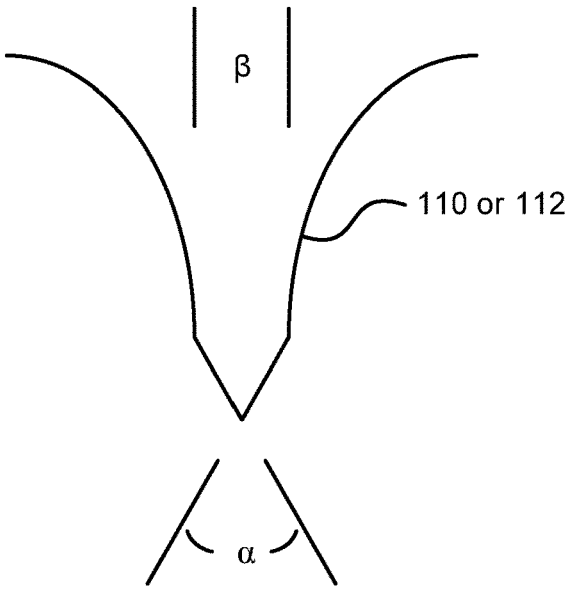
FIG. 4 is a top view of a cutting wedge in accordance with one embodiment of the present invention.

FIG. 4 is a top view of a cutting wedge (i.e. 110, 112) in accordance with one embodiment of the present invention. In one embodiment, the first cutting wedge 110 and the second cutting wedge 112 each taper to the cutting edge by way of a wedge shape. The cutting edge is the bottom tip of the cutting wedge in FIG. 4 and the wedge shape includes the two sides on either side of the cutting edge. In one embodiment, the wedge shape has an angle $\alpha$ of between 50 degrees and 80 degrees. As shown, the angle $\alpha$ is measured with respect to the cutting edge and between a surface of the wedge shape on either side of the cutting edge. In another embodiment, the angle $\alpha$ is approximately 60 degrees. As used herein, approximately 60 degrees includes angles of 60 degrees and a few degrees more or less than 60 degrees, such as 55-65 degrees. The cutting wedge may have and angle $\alpha$ that provides a sharp edge while providing a splitting force due to the angle $\alpha$. One of skill in the art will recognize an appropriate angle $\alpha$ that provides a balance between sharpness, durability, and providing a splitting force.

The cutting wedge may also have a specific width $\beta$, which is chosen to be wide enough to cut a desired object while providing enough width to minimize flexing while cutting. Typical designs include a razor blade or other blade that is thin and deflects under pressure redirecting the cutting force in an undesirable direction. Choosing the width $\beta$ to minimize flexing of the cutting wedges 110, 112 while cutting helps to create a cleaner cut. The wedge shape may be advantageous because the wedge shape provides a force to move the object being split apart while cutting the object. The wedge shape may also be advantageous over razor blades or other very thin cutters because the wedge shape may maintain sharpness longer than other thin blades for durability while providing a shape that forces the object apart. The width $\beta$ may be sufficient to minimize flexing and may be 0.05 inches or more. The cutting wedges (i.e. 110, 112) may also be attached securely to the base 102 for added stability.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, the apparatus comprising:

a base;

a fixed member attached to the base, the fixed member comprising a first cutting wedge;

a lever arm pivotably attached to one or more of the base and the fixed member at a pivot point, the lever arm comprising a second cutting wedge, the lever arm positionable between an open position and a closed position, wherein the lever arm rotates to move the second cutting wedge to contact the first cutting wedge where a cutting surface of the first cutting wedge aligns with a cutting surface of the second cutting wedge when the lever arm is in the closed position, wherein the cutting surface of the first cutting wedge and the cutting surface of the second cutting wedge are oriented parallel to an axis of rotation of the pivot point, and wherein the base, the fixed member, and the lever arm form, in a closed position, a first compartment on a first side of the first and second cutting wedges and form a second compartment, separate from the first compartment, on a second side of the first and second cutting wedges, the first side opposite the second side, wherein the base forms a bottom to the first and second compartments; and a cover positionable over only one side of the first and second compartments formed by the base, the fixed member, and the lever arm, wherein the first and second compartments are enclosed when the cover is positioned over the first and second compartments and the lever arm is in the closed position, wherein the cover is separately pivotable from the lever arm.

2. The apparatus of claim 1, wherein the first cutting wedge and the second cutting wedge each taper to the cutting edge by way of a wedge shape.

3. The apparatus of claim 2, wherein the wedge shape has an angle of between 50 degrees and 80 degrees, the angle measured with respect to the cutting edge and between a surface of the wedge shape on either side of the cutting edge.

4. The apparatus of claim 3, wherein the angle is between 55 and 65 degrees.

5. The apparatus of claim 1, wherein the first cutting wedge and the fixed member are of unitary construction and the second cutting wedge and the lever arm are of unitary construction.

6. The apparatus of claim 1, wherein the cover is attached to the apparatus at a pivot point, wherein the cover rotates between a closed position and an open position, where the cover in the closed position covers the first and second compartments and in the open position exposes the first and second compartments for access.

7. The apparatus of claim 1, further comprising a recess in the base adjacent to the first cutting wedge, the recess shaped to accommodate an edge of an object to be cut and to support the object in a position to split the object when the lever arm moves between the open position and closed position.

8. The apparatus of claim 1, wherein the cover is transparent over a portion of the apparatus where the first and second cutting wedges meet.

9. The apparatus of claim 1, wherein the cover comprises a top of the first and second compartments.

10. The apparatus of claim 1, wherein the first and second compartments are arcuate.

11. The apparatus of claim 1, wherein the cover connects to the apparatus at the pivot point of the lever arm.

12. The apparatus of claim 11, further comprising a pivot member, wherein one of the pivot member extends through the cover and the lever arm and connects to one or more of the base and the fixed member; and a portion of the pivot member extends through one or more of the fixed member and the base and connects to the lever arm and a portion of the pivot member extends through the cover and connects to the lever arm.

13. The apparatus of claim 1, wherein the first cutting wedge and the second cutting wedge each have a width that spans a space between the base and a top edge of the fixed member and the lever arm, the top edge of the fixed member and the top edge of the lever arm distal to the base.

14. An apparatus comprising:

a fixed base, the fixed base comprising a base, a fixed member and a first cutting edge;

a lever arm attached to the fixed base at a pivot point, the lever arm comprising a second cutting wedge;

a pivot member coupling the lever arm to the fixed base at the pivot point, wherein the lever arm is positionable between an open position and a closed position, wherein the lever arm rotates with respect to the pivot point to move the second cutting wedge to contact the first cutting wedge where a cutting surface of the first cutting wedge aligns with a cutting surface of the second cutting wedge when the lever arm is in the closed position, wherein the cutting surface of the first cutting wedge and the cutting surface of the second cutting wedge are oriented parallel to an axis of rotation of the pivot point, and wherein the base, the fixed member, and the lever arm, in a closed position, form a first compartment on a first side of the first and second cutting wedges and form a second compartment, separate from the first compartment, on a second side of the first and second cutting wedges, the first side opposite the second side, wherein the base forms a bottom to the first and second compartments; and a cover rotatably coupled to the apparatus at the pivot point, the cover rotating between a first position that covers only one side of the first and second compartments when the lever arm is in the closed position, and an open position that exposes at least a portion of the first and second compartments, wherein the first and second compartments are enclosed when the lever arm is in the closed position and the cover is over the compartments, wherein the cover is separately pivotable from the lever arm.

15. The apparatus of claim 14, wherein the cover comprises a material that is see-through for at least the first compartment and second compartment.

16. The system of claim 14, wherein the fixed member is shaped to accommodate the lever arm at the pivot point to maintain a joint substantially without a gap while the lever arm rotates between the open position and closed position.

17. An apparatus comprising:

a base;

a fixed member attached to the base, the fixed member comprising a first cutting wedge;

a lever arm pivotably attached to one or more of the base and the fixed member at a pivot point, the lever arm comprising a second cutting wedge, the lever arm positionable between an open position and a closed position, wherein the first cutting wedge and the second cutting wedge each taper to corresponding cutting surfaces by way of a wedge shape, wherein each wedge shape has an angle between 50 degrees and 80 degrees with respect to the cutting edge;

a cover rotatably coupled to the base at the pivot point, the cover shaped to cover only one side of two separate compartments formed between the base, the fixed member, the first and second cutting wedges, and the lever arm when the lever arm is in the closed position, wherein the compartments are enclosed when the lever arm is in the closed position and the cover is over the two compartments, wherein rotation of the cover, separate from rotation of the lever arm, exposes one or both of the compartments, wherein the cover comprises a transparent material so the two compartments are visible through the cover; and a pivot member located at the pivot point and extending through the cover and lever arm and attached to one of the fixed member and the base, wherein the cutting surface corresponding to the first cutting wedge and the cutting edge corresponding to the second cutting wedge are oriented parallel to an axis of rotation of the pivot point and wherein the lever arm rotates to move the second cutting wedge to contact the first cutting wedge where the cutting surface of the first cutting wedge aligns with the cutting surface of the second cutting wedge when the lever arm is in the closed position.

* * * * *